US009511964B2

(12) United States Patent
Shiokawa et al.

(10) Patent No.: US 9,511,964 B2
(45) Date of Patent: Dec. 6, 2016

(54) SHEET PROCESSING APPARATUS AND IMAGE FORMING SYSTEM

(71) Applicant: KONICA MINOLTA, INC., Chiyoda-ku, Tokyo (JP)

(72) Inventors: Tsuyoshi Shiokawa, Hachioji (JP); Atsushi Arai, Tachikawa (JP)

(73) Assignee: KONICA MINOLTA, INC., Tokyo (JP)

( * ) Notice: Subject to any disclaimer, the term of this patent is extended or adjusted under 35 U.S.C. 154(b) by 13 days.

(21) Appl. No.: 14/476,414

(22) Filed: Sep. 3, 2014

(65) Prior Publication Data

US 2015/0065325 A1 Mar. 5, 2015

(30) Foreign Application Priority Data

Sep. 5, 2013 (JP) ..... 2013-184015

(51) Int. Cl.

| | |
|---|---|
| ***B65H 5/14*** | (2006.01) |
| ***B65H 5/04*** | (2006.01) |
| ***B65H 5/10*** | (2006.01) |
| ***B65H 7/20*** | (2006.01) |
| ***B31F 1/00*** | (2006.01) |

(Continued)

(52) U.S. Cl.

CPC ..... *B65H 5/14* (2013.01); *B31F 1/0035* (2013.01); *B42B 9/04* (2013.01); *B42C 19/08* (2013.01); *B65H 5/04* (2013.01); *B65H 5/10* (2013.01); *B65H 7/20* (2013.01); *B65H 2301/4224* (2013.01); *B65H 2301/515* (2013.01)

(58) Field of Classification Search

CPC ..... B65H 5/04; B65H 5/10; B65H 5/14; B65H 2301/4224; B65H 2301/515; B65H 7/20; B31F 1/0035

USPC ..... 270/32, 52.17, 58.07; 412/9, 16, 18

See application file for complete search history.

(56) References Cited

U.S. PATENT DOCUMENTS

| | | | | |
|---|---|---|---|---|
| 5,878,999 | A | 3/1999 | Neri et al. | |
| 7,325,799 | B2 * | 2/2008 | Watkiss | 270/39.08 |
| 7,484,721 | B2 * | 2/2009 | Tsukui et al. | 270/58.12 |

(Continued)

FOREIGN PATENT DOCUMENTS

| | | | |
|---|---|---|---|
| CN | 1173457 | A | 2/1998 |
| JP | 58017064 | A | 2/1983 |

(Continued)

OTHER PUBLICATIONS

Japanese Office Action (and English translation thereof) dated Jul. 28, 2015, issued in counterpart Japanese Application No. 2013-184015.

(Continued)

*Primary Examiner* — Leslie A Nicholson, III

(74) *Attorney, Agent, or Firm* — Holtz, Holtz & Volek PC

(57) ABSTRACT

A sheet processing apparatus vertically conveys a sheet which includes a crease at a center of the sheet and which is in a vertical state where the crease is on the top and a fore edge of the sheet is on the bottom. The apparatus includes the first holder which clamps and holds the sheet and the second holder which clamps and holds the sheet while corrugating the sheet. The second holder holds the sheet while the first holder holds the first part of the sheet, and then, while the second holder holds the sheet, the first holder releases the first part of the sheet, moves along the sheet and holds the second part of the sheet.

12 Claims, 11 Drawing Sheets

(51) Int. Cl.
*B42B 9/04* (2006.01)
*B42C 19/08* (2006.01)

(56) References Cited

U.S. PATENT DOCUMENTS

| | | | | |
|---|---|---|---|---|
| 8,123,447 | B2 * | 2/2012 | Richter et al. | 412/4 |
| 8,317,181 | B2 * | 11/2012 | Suzuki | 270/45 |
| 8,382,090 | B2 * | 2/2013 | Sasamoto | B42C 1/12 270/58.07 |
| 8,894,056 | B2 * | 11/2014 | Oshima | 270/52.26 |
| 2013/0154176 | A1 | 6/2013 | Oshima | |

FOREIGN PATENT DOCUMENTS

| | | | |
|---|---|---|---|
| JP | 08059045 | A | 3/1996 |
| JP | 2005132565 | A | 5/2005 |
| JP | 2010001109 | A | 1/2010 |
| JP | 2013124171 | A | 6/2013 |

OTHER PUBLICATIONS

Chinese Office Action (and English translation thereof) dated Feb. 22, 2016, issued in counterpart Chinese Application No. 201410448823.0.

Chinese Office Action (and English translation thereof) dated Aug. 31, 2016, issued in counterpart Chinese Application No. 201410448823.0.

* cited by examiner

SHEET PROCESSING APPARATUS AND IMAGE FORMING SYSTEM

BACKGROUND OF THE INVENTION

1. Field of the Invention

The present invention relates to a sheet processing apparatus and an image forming system.

2. Description of Related Art

In order to achieve miniaturization and better operability of a saddle stitching bookbinder, some known bookbinders have been configured as follows. A trimming section for a fore edge is placed at the bottom of the bookbinder while an ejecting section is placed at the top. The bookbinder conveys a saddle-stitched booklet in the up and down direction while the first holder holds the booklet in a vertical state where the crease of the booklet is at the top and the fore edge is at the bottom.

When the bookbinder with such configuration trims a fore edge, a part around the crease of the saddle-stitched booklet must be held so that the booklet is sufficiently inserted into the trimming section. Also, when the saddle-stitched booklet is passed to the ejecting section, a part around the fore edge must be held so that the booklet is sufficiently inserted into the ejecting section. Thus a part of the saddle-stitched booklet by which the booklet is held must be changed.

One possible method for changing the part by which the first holder holds the saddle-stitched booklet is, for example, to provide the second holder which holds the booklet from below. While this second holder temporarily holds the booklet, the first holder changes the part by which the holder holds the booklet.

As for the second holder which holds the booklet from below, Japanese Patent Application Laid Open Publication No. 2010-1109 discloses a tray which includes a sheet receiving unit at its bottom and which is set in an inclined state although it is approximately vertical. This tray includes a pressing member that presses stacked sheets.

The tray described in the above publication holds a bundle of sheets while the sheet receiving unit contacts a fore edge of the bundle of sheets (saddle-stitched booklet). Such configuration may damage the fore edge of the bundle of sheets.

Further, the pressing member of the tray described in the above publication presses a surface of the sheets with its flat surface. Therefore, when sheets are not hard enough or the like, the sheets may fall flat.

SUMMARY OF THE INVENTION

The present invention has been made in consideration of the above problems in conventional techniques, and an object of the present invention is to provide a sheet processing apparatus and an image forming system which can keep sheets in a stable state without damaging the sheets when the sheets in a vertical state are conveyed upward or downward, and which can change a part by which the sheets are held.

In order to achieve the above object, according to one aspect of the present invention, there is provided a sheet processing apparatus which vertically conveys a sheet which includes a crease at a center of the sheet and which is in a vertical state where the crease is on a top and a fore edge of the sheet is on a bottom, the apparatus including: a first holder which clamps and holds the sheet; a second holder which clamps and holds the sheet while corrugating the sheet; and a control unit which controls operation of the first and the second holders, wherein the control unit controls the first and the second holders such that the second holder holds the sheet while the first holder holds a first part of the sheet, and then, while the second holder holds the sheet, the first holder releases the first part of the sheet, moves along the sheet and holds a second part of the sheet.

Preferably, in the sheet processing apparatus, the control unit controls the first holder to move along the sheet in a vertical direction.

Preferably, in the sheet processing apparatus, the control unit controls the first holder to move along the sheet downward.

Preferably, in the sheet processing apparatus, the first holder is placed above the second holder, the second holder holds a part around the fore edge of the sheet, and the first part is a part around the crease of the sheet while the second part is a center of the sheet in an up and down direction.

Preferably, in the sheet processing apparatus, the second holder includes a curved portion at a portion where the second holder contacts the sheet.

Preferably, in the sheet processing apparatus, the second holder includes an elastic member at a portion where the second holder contacts the sheet.

Preferably, in the sheet processing apparatus, the second holder includes a mirror-finished portion at a portion where the second holder contacts the sheet.

Preferably, the sheet processing apparatus further includes a trimming section which trims the fore edge of the sheet, and the control unit controls the first holder to move down holding the first part and controls the trimming section to trim the fore edge of the sheet.

Preferably, the sheet processing apparatus further includes a square back forming section which squeezes the crease of the sheet flat to form a square back, and the control unit controls the first holder to move holding the first part of the sheet and controls the square back forming section to form the square back along the crease.

Preferably, the sheet processing apparatus further includes a trimming section which trims the fore edge of the sheet and a square back forming section which squeezes the crease of the sheet flat to form a square back, and, while the first holder holds the first part, the control unit controls the trimming section to trim the fore edge and controls the square back forming section to form the square back along the crease.

According to another aspect of the present invention, there is provided an image forming system, including: an image forming apparatus which forms an image on a sheet; and the sheet processing apparatus which is connected to the image forming apparatus, wherein the crease is formed at the center of the sheet after the image forming apparatus forms an image on the sheet.

BRIEF DESCRIPTION OF THE DRAWINGS

The above and other objects, advantages and features of the present invention will become more fully understood from the detailed description given hereinbelow and the appended drawings which are given byway of illustration only, and thus are not intended as a definition of the limits of the present invention, and wherein.

DETAILED DESCRIPTION OF THE PREFERRED EMBODIMENT

Figure 1:
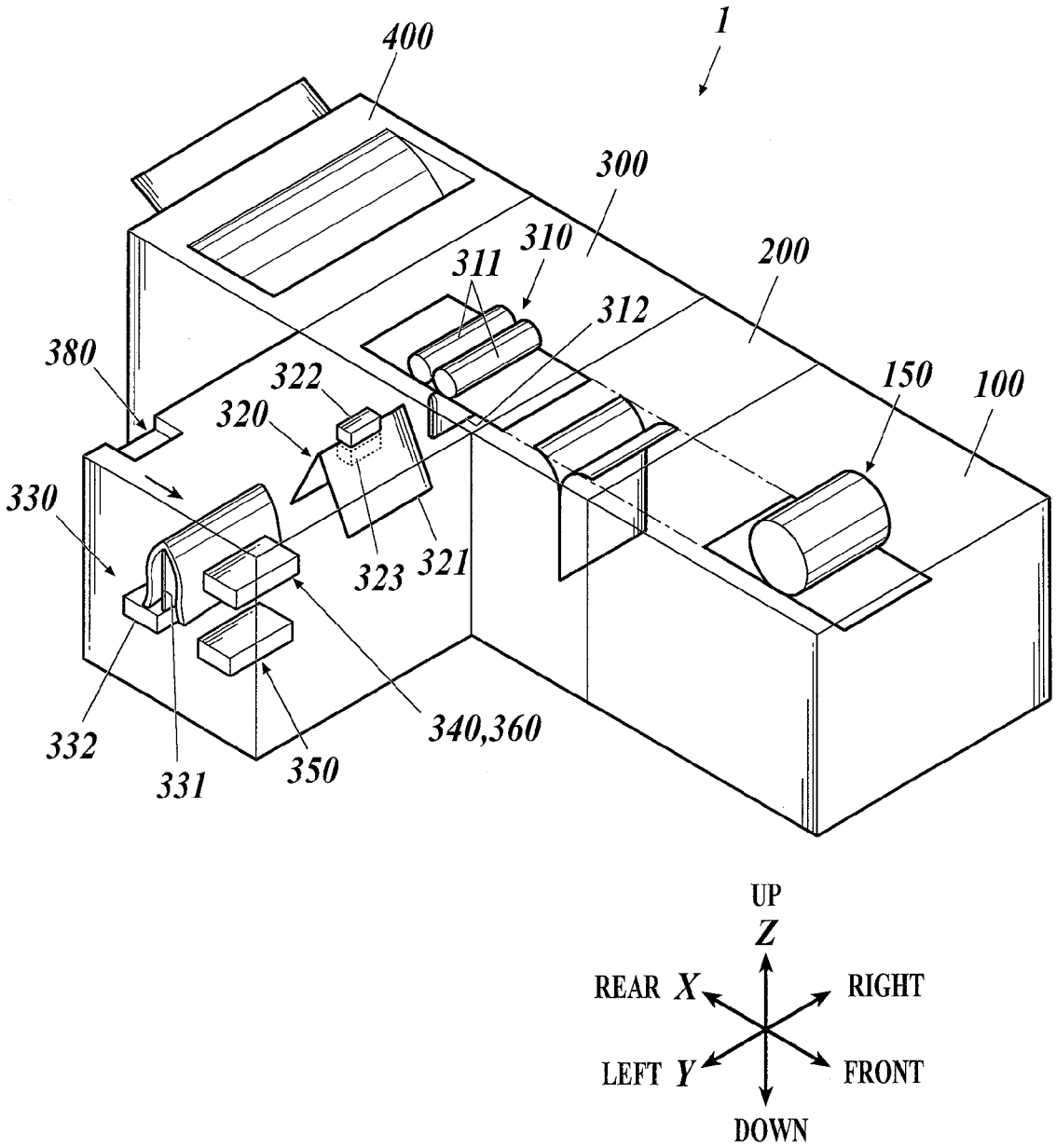
FIG. 1 is a schematic view illustrating the entire configuration of an image forming system.

An image forming system 1 according to an embodiment of the present invention will now be described referring to the drawings.

FIG. 1 is a schematic view illustrating the entire configuration of the image forming system 1.

As shown in FIG. 1, the image forming system 1 includes an image forming apparatus 100, an intermediate conveyance apparatus 200, a sheet processing apparatus 300 and a side stitching apparatus 400.

In the following description, the vertical direction is referred to as Z direction. The direction in which the image forming apparatus 100, the intermediate conveyance apparatus 200, the sheet processing apparatus 300 and the side stitching apparatus 400 in FIG. 1 are connected with each other is referred to as X direction. The direction orthogonal to both the X and Z directions is referred to as Y direction.

The X direction has front and rear sides and the Y direction has right and left sides. The front side is upstream and the rear side is downstream when a sheet is conveyed in the image forming system 1. The right side is upstream and the left side is downstream when a sheet is conveyed in half folding and saddle stitching processing by the saddle stitching apparatus 300.

The image forming apparatus 100 forms an image on a sheet of paper.

In specific, the image forming apparatus 100 for forming an image on a sheet includes, for example, a conveyance section to extract and convey a sheet from the sheets stored as recording media from a sheet tray, a developing section to develop a toner image based on bitmap data onto a first transfer member such as transfer roller, a first transfer section to transfer the toner image developed on the first transfer member onto a second transfer member such as a transfer drum 150, a second transfer section to transfer the toner image on the second transfer member onto the sheet conveyed by the conveyance section, a fixing section to fix the transferred toner image onto the sheet, and an ejecting section to eject the sheet after the fixation by the fixing section.

The image forming apparatus 100 passes the ejected sheet which has the image formed thereon to the intermediate conveyance apparatus 200. That is, the connection in the image forming system 1 allows the sheet ejected from the image forming apparatus 100 to be passed to the intermediate conveyance apparatus 200.

The intermediate conveyance apparatus 200 can temporarily stack a sheet and score and trim the sheet.

Specifically, the intermediate conveyance apparatus 200 includes, for example, a standby section (stacker) which conveys downward a sheet conveyed from the image forming apparatus 100 and makes the sheet stop once to standby with the sheet surface along the Z direction; an alignment section which aligns the position of the sheet during standby; a scoring section (creaser) which scores the aligned sheet; and a trimming section (slitter) which trims off margins in the sheet while the conveyance of the scored sheet.

That is, the intermediate conveyance apparatus 200 once stops the sheet passed from the image forming apparatus 100 at the standby section, aligns the sheet with the alignment section, scores the sheet with the scoring section, and thereafter trims the margins in the sheet with the trimming section while conveying the scored sheet. Then, the intermediate conveyance apparatus 200 passes the sheet with the margins trimmed off by the trimming section to the sheet processing apparatus 300.

The intermediate conveyance apparatus 200 can also pass the sheet received from the image forming apparatus 100 to the sheet processing apparatus 300 without performing a part or all of the various processes by the intermediate conveyance apparatus 200.

The sheet processing apparatus 300 performs half folding that is folding the sheet in half (in two), saddle stitching that is stapling a predetermined number of stacked half-folded sheets to create a saddle-stitched booklet, trimming that is trimming a fore edge of the booklet, square back forming that is forming a square back, and such like.

In specific, the sheet processing apparatus 300 includes, for example:

a half folding section 310 which folds the sheet received from the intermediate conveyance apparatus 200 in half along the Y direction;

a saddle stitching section 320 which overlays the folded sheets and which inserts staples into the sheet bundle to form a saddle-stitched booklet;

a sheet conveyance mechanism 330 which receives the saddle-stitched booklet and which conveys the booklet in the direction perpendicular to the crease (X direction) along a horizontal plane;

a clamping section (the first holder) 340 which clamps a part around the crease of the saddle-stitched booklet conveyed by the sheet conveyance mechanism 330;

a trimming section 350 which trims a fore edge of the saddle-stitched booklet held by the clamping section 340;

a square back forming section 360 which forms a square back along the spine of the saddle-stitched booklet;

an edge holding section (the second holder) 370 which holds an end portion on the side of the fore edge of the saddle-stitched booklet; and an ejecting section 380 which ejects the saddle-stitched booklet outward.

This sheet processing apparatus 300 can also pass the sheet received from the intermediate conveyance apparatus 200 to the side stitching apparatus 400 without performing a part or all of the various processes by the sheet processing apparatus 300.

The half folding section 310 includes, for example, a pair of half folding rollers 311, 311 and a plate-like folding knife 312 which is located along the Y-Z plane below the pair of half folding rollers 311, 311 and which is movable so as to come between the half folding rollers 311, 311.

A sheet received from the image forming apparatus is conveyed until the center of the sheet in the X direction faces the folding knife 312. Then the folding knife 312 comes between the half folding rollers 311, 311, and thereby pushes the sheet into the nip unit. Thus, the sheet is folded in two so as to have a crease along the Y direction at the position contacting the folding knife 312. That is, the sheet is in what is called a mountain fold shape with the crease up and the both edges down (mountain-shaped sheet).

The half-folded sheet is conveyed in the direction (Y direction) along the crease to the saddle stitching section 320 by a conveyance section, which is not shown in drawings.

The saddle stitching section 330 includes a saddle unit 321 to overlay and accumulate sheets conveyed from the half folding section 310, a staple inserting section 322 provided above the saddle unit 321, a staple receiving section 323 provided inside the saddle unit 321, etc.

After a predetermined number of sheets are stacked on the saddle unit 321, the staple inserting section 322 and the staple receiving section 323 cooperate to insert a staple into the crease of the sheets so that a saddle-stitched booklet is formed. The formed saddle-stitched booklet is pushed out to the sheet conveyance mechanism 330 downstream by an alignment section (not shown in drawings) provided at the right end (the upstream end in the conveyance direction) of the saddle unit 321.

The sheet conveyance mechanism 330 includes a plate-like movable saddle 331 placed along the Y-Z plane and a movable unit 332 which is movable both ways in the X direction.

After the saddle-stitched booklet is pushed out of the saddle stitching section 320, the movable saddle 331 supports the crease (stitch portion) of the booklet from below. After the movable saddle 331 supports the saddle-stitched booklet, the movable unit 332 moves to the front side from the rear side in the X direction to pass the booklet to the clamping section 340.

In order to keep an appropriate position of the saddle-stitched booklet on the movable saddle 331, the movable unit 332 is preferably provided with the first press member which presses the crease of the saddle-stitched booklet, which is supported by the movable saddle 331, from above. Further, in order to prevent the saddle-stitched booklet from rising while being conveyed, the movable unit 332 is preferably provided with the second press member which presses the saddle-stitched booklet from the rear side in the conveyance direction.

Figure 2:
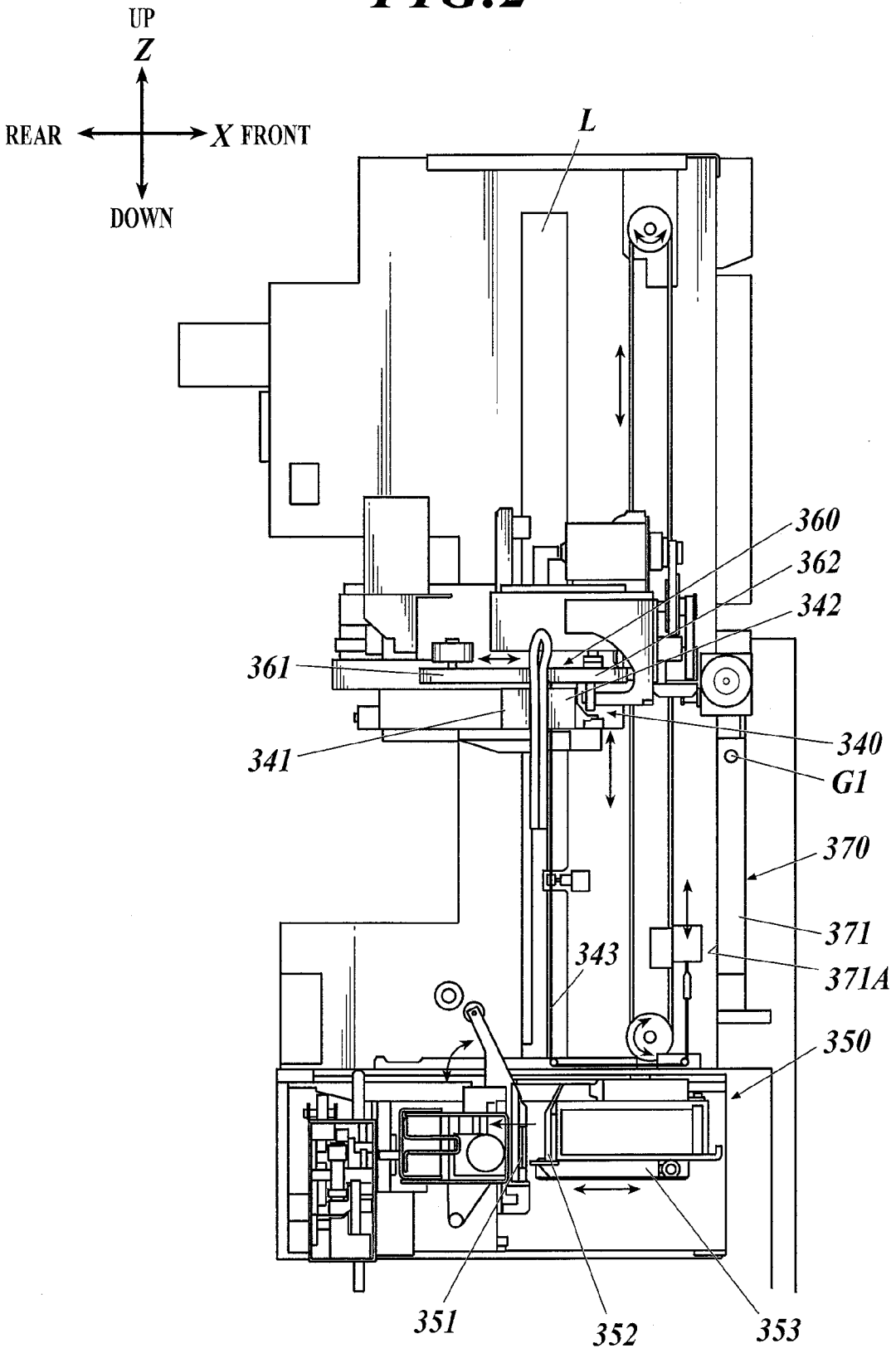
FIG. 2 illustrates an example of a configuration including a clamping section, a trimming section, a square back forming section and an edge holding section.

FIG. 2 shows an example of configuration of the clamping section 340, the trimming section 350, the square back forming section 360 and the edge holding section 370 of the sheet processing apparatus 300.

As shown in FIG. 2, the clamping section 340 is placed above the trimming section 350 and can move up and down along a guide rail L placed along the Z direction.

The clamping section 340 includes a pair of clamp members 341, 342 and clamps the saddle-stitched booklet after the sheet conveyance mechanism 330 conveys the booklet from the rear to the front.

Figure 3A:
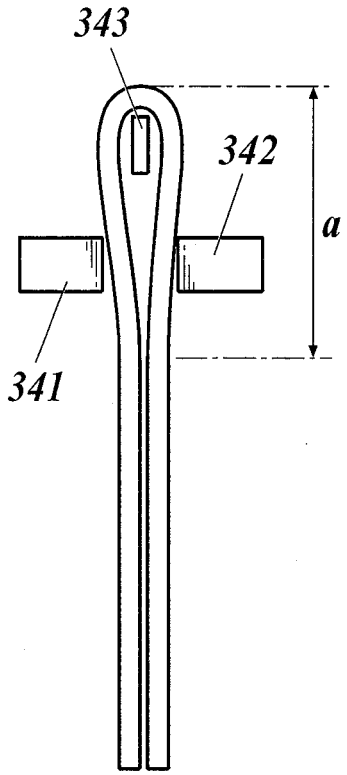
FIG. 3A is a schematic view illustrating the first part by which the clamping section clamps a saddle-stitched booklet.

Specifically, while the saddle-stitched booklet is between the clamping section 340 and the trimming section 350, the clamping section 340 goes down, and the pair of clamp members 341, 342 are positioned such that the clamp members 341, 342 can clamp a part (the first part "a") around the crease of the saddle-stitched booklet supported by the movable saddle 331. Then, as shown in FIG. 3A, a lifter plate 343 of the clamping section 340 pushes up the saddle-stitched booklet from below to raise the saddle-stitched booklet. In this state, the pair of clamp members 341, 342 come close to each other to clamp the part around the crease of the saddle-stitched booklet.

After the pair of clamp members 341, 342 clamp the saddle-stitched booklet, the movable unit 332 escapes toward the rear side.

As the clamping section 340 goes down clamping the saddle-stitched booklet as described above, the fore edge side of the saddle-stitched booklet enters the trimming section 350.

The trimming section 350 includes trim and clamp members 351, 352. The fore edge of the saddle-stitched booklet enters the space between the trim and clamp members 351, 352 and moves to a predetermined position. Then a trimming knife 353 moves in the Y direction trimming the fore edge of the saddle-stitched booklet. Thereby the uneven fore edge of the saddle-stitched booklet is trimmed.

The square back forming section 360 is placed on clamping section 340.

The square back forming section 360 is provided with holding plates 361, 362, a roller (not shown in drawings), etc. The holding plates 361, 362 are placed above the pair of clamp members 341, 342 of the clamping section 340.

Figure 3B:
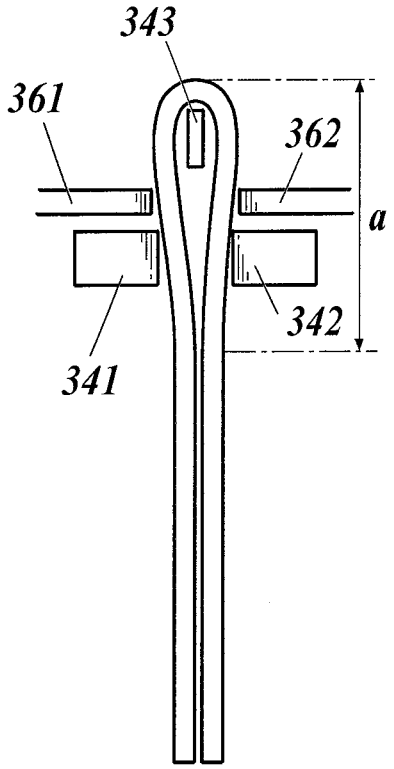
FIG. 3B is a schematic view illustrating the first part by which the clamping section clamps the saddle-stitched booklet.
Figure 3B:
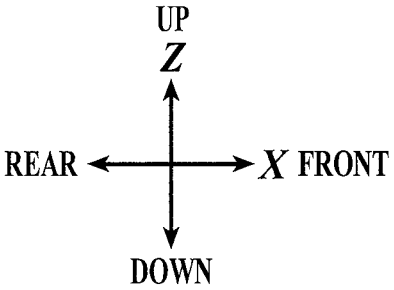

As shown in FIG. 3B, in the square back forming, the lifter plate 343 slightly raise the saddle-stitched booklet, and the holding plates 361, 362 clamp the booklet by a part around the crease which is above a part by which the pair of clamp members 341, 342 clamp the booklet.

When the lifter plate 343 raises the saddle-stitched booklet, the pair of the clamp members 341, 342 of the clamping section 340 are slightly separated from each other (semi-clamp state). The saddle-stitched booklet is raised while sliding on the clamp members 341, 342. After raising, the pair of clamp members 341, 342 come close to each other to clamp the saddle-stitched booklet (complete clamp state). This operation prevents the saddle-stitched booklet from being damaged during the lifter plate 343 raises the saddle-stitched booklet in the square back forming. The saddle-stitched booklet is raised by 7 mm at the longest. Therefore, even after this operation, the part of the saddle-stitched booklet by which the pair of clamp members 341, 342 clamp the booklet is still near the crease (the first part "a") of the booklet.

Then the lifter plate 343 comes out in the Y direction, and the roller squeezes the crease of the saddle-stitched booklet flat to form a square back. After this square back forming, the holding plates 361, 362 leave the saddle-stitched booklet.

This square back forming is performed before trimming the fore edge. In this case, the square back forming section 360 may form a square back before the clamping section 340 moves. Alternatively, the square back forming section 360 may form a square back after the saddle-stitched booklet moves down by a predetermined height as the clamping section 340 moves.

Since the square back forming section 360 is placed on the clamping section 340, the square back forming section 360 may form a square back along the crease of the saddle-stitched booklet while the clamping section 340 moves down to the trimming section 350 and the trimming section 350 trims the fore edge of the saddle-stitched booklet. In this case, two kinds of processing are performed at the same time, which increases productivity.

In the above trimming by the trimming section 350 and the square back forming by the square back forming section 360, the pair of clamp members 341, 342 of the clamping section 340 clamp the saddle-stitched booklet by the part around the crease of the saddle-stitched booklet (the first part "a").

Such clamp position allows the saddle-stitched booklet to enter the space between the trim and clamp members 351, 352 by a sufficient length in trimming and also allows the portion around the crease to be fixed in square back forming.

However, in ejecting of the saddle-stitched booklet, when the booklet is passed to the ejecting section 380 above the clamping section 340 to eject the booklet, the part by which the pair of clamp members 341, 342 clamp the booklet must be changed to allow the booklet to enter the ejecting section 380 by a sufficient length.

When the part by which the pair of clamp members 341, 342 of the clamping section 340 clamp the saddle-stitched booklet is changed, the edge holding section 370 clamps and holds the booklet while corrugating the booklet.

Figure 4:
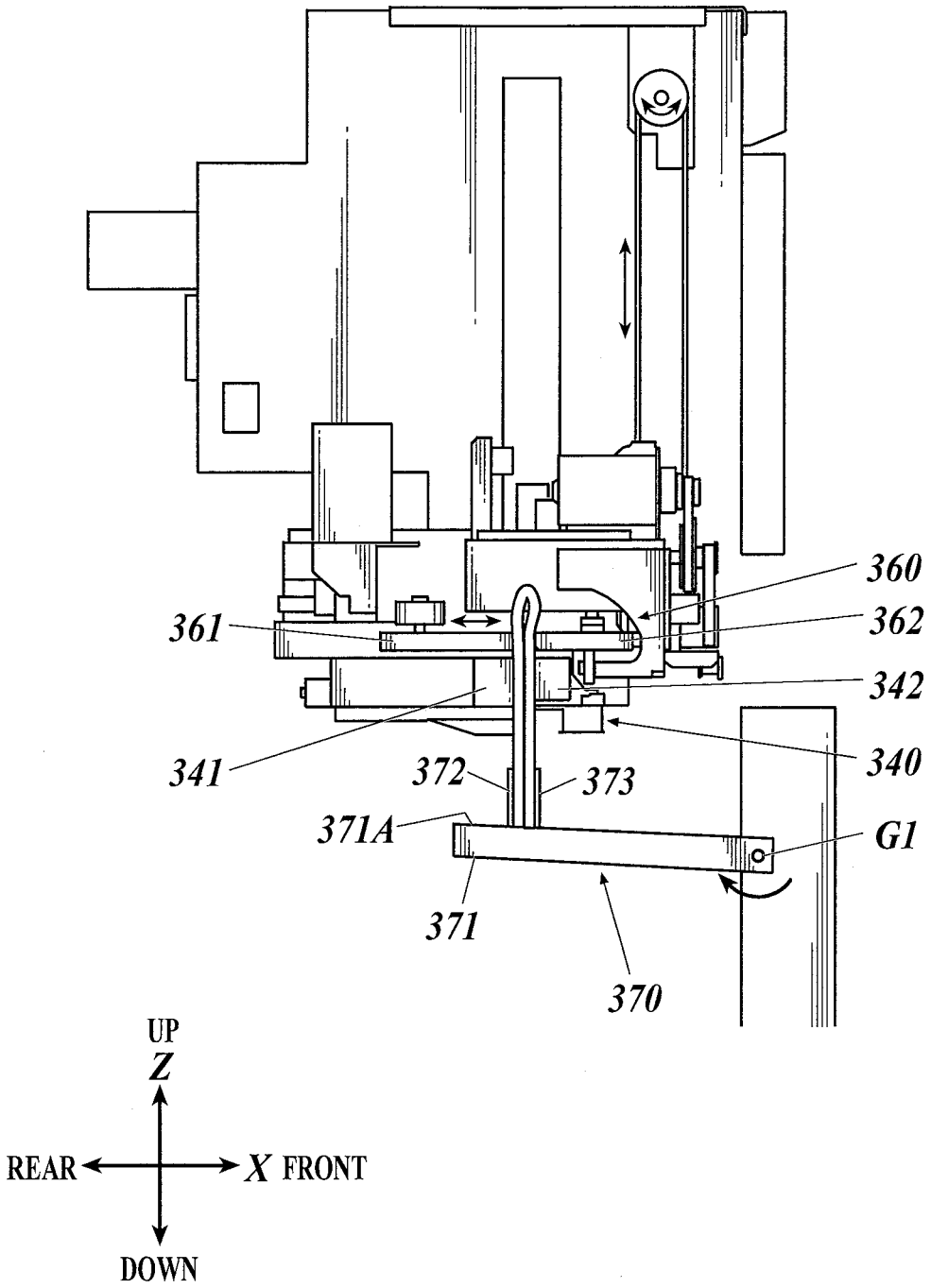
FIG. 4 illustrates a state where the edge holding section holds the saddle-stitched booklet.
Figure 5:
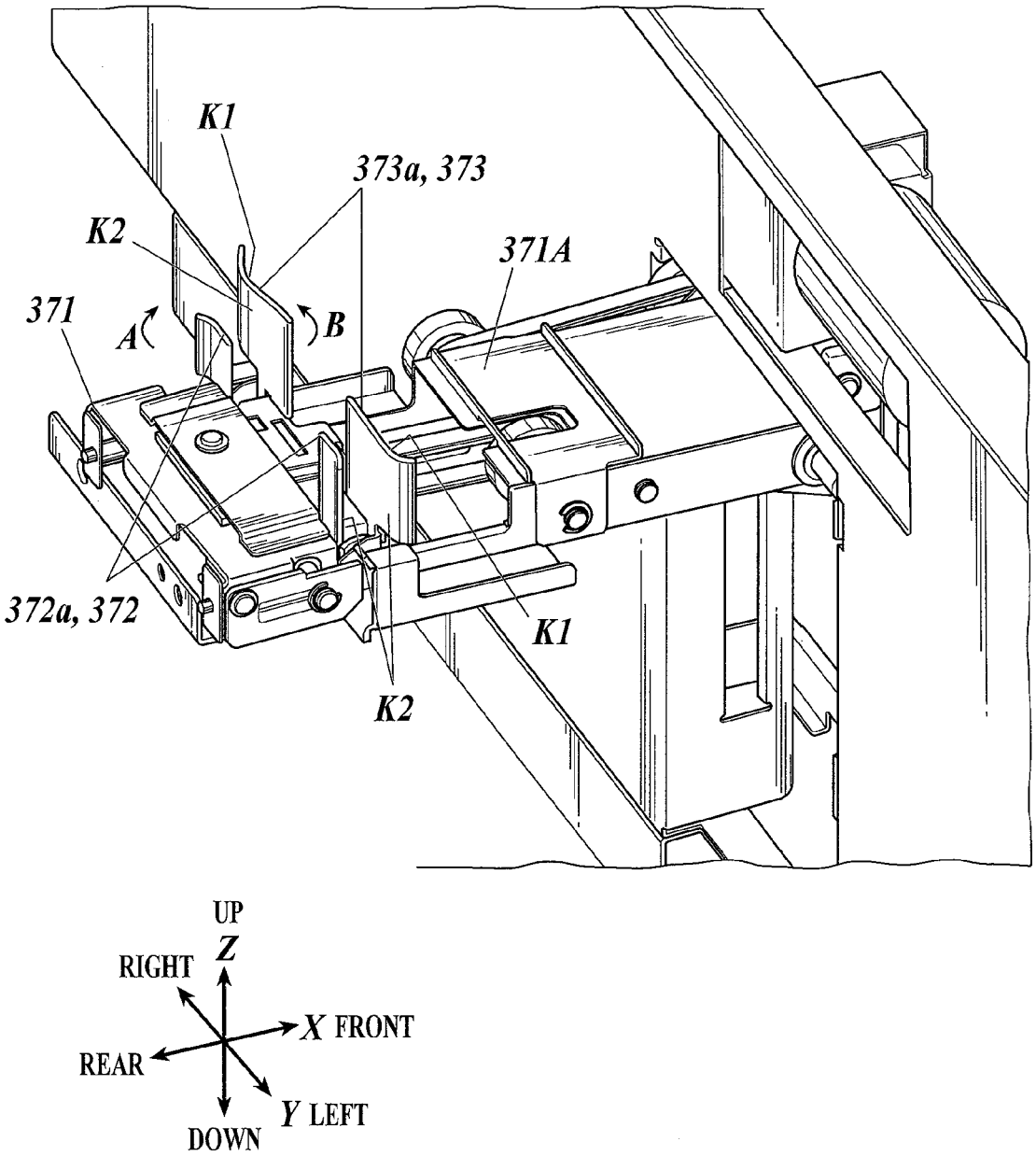
FIG. 5 is a perspective view illustrating a main configuration of the edge holding section.
Figure 6:
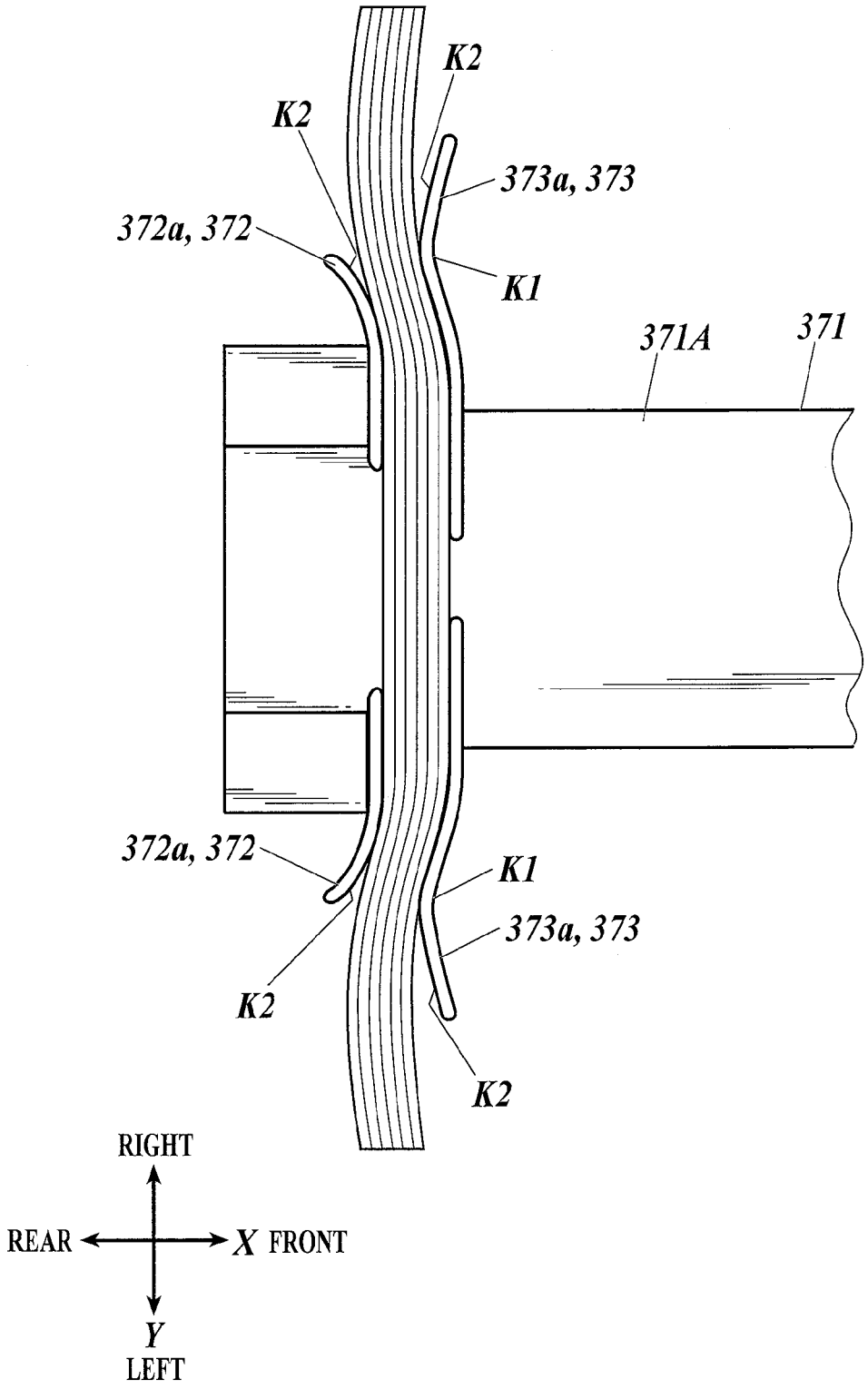
FIG. 6 is a top view illustrating a state where the edge holding section holds the saddle-stitched booklet.

FIG. 4 shows a state where the edge holding section 370 holds the end of the saddle-stitched booklet on the fore edge side. FIG. 5 is a perspective view of the edge holding section 370. FIG. 6 is a top view showing a state where the edge holding section 370 holds the saddle-stitched booklet.

The edge holding section includes a holding unit 371 which has a flat box shape and which is rotatable around a rotation axis G1.

When trimming or square back forming is performed, the main face 371A of the holding unit 371 is vertical along the Y-Z plane (see FIG. 2). On the other hand, when the saddle-stitched booklet is ejected, the first drive unit 371*a* (see FIG. 9) drives the holding unit 371 to make the holding unit 371 rotate around the rotation axis G1 so that the main face 371A become approximately horizontal along the X-Y plane as shown in FIG. 4 and FIG. 5.

The main face 371A of the holding unit 371 includes edge clamp members 372, 373 which stand up on the main face 371A when the holding unit 371 become approximately horizontal.

The edge clamp member 372 is constituted by, for example, a pair of plate members 372*a*, 372*a* which are separated from each other by a predetermined distance in the Y direction.

When the holding unit 371 is perpendicular, the pair of plate members 372*a*, 372*a* are on the same plane as the main face 371A of the holding unit 371. When the holding unit 371 is approximately horizontal, the second drive unit M1 (see FIG. 9) drives the pair of plate members 372*a*, 372*a* to make the drive members 372*a*, 372*a* rotate in the arrow A direction in FIG. 5 to stand up on the main face 371A.

The edge clamp member 373 is constituted by, for example, a pair of plate members 373*a*, 373*a* which are separated from each other by a predetermined distance in the Y direction and which are positioned to face the pair of plate members 372*a*, 372*a*.

When the holding unit 371 is perpendicular, the pair of plate members 373*a*, 373*a* are on the same plane as the main face 371A of the holding unit 371. When the holding unit 371 is approximately horizontal, the third drive unit M2 (see FIG. 9) drives the plate members 373*a*, 373*a* to make the plate members 373*a*, 373*a* rotate in the arrow B direction in FIG. 5 to stand up on the main face 371A.

As shown in FIG. 6, the edge clamp member 373 (the plate member 373*a*) includes a curved portion K1 which is convex toward the saddle-stitched booklet.

Thereby, when the lower end of the saddle-stitched booklet is clamped, the curved portion K1 contacts the booklet to corrugate the booklet so that the booklet is prevented from falling flat.

The plate member 372*a* of the edge clamp member 372 may also include a curved portion K1 on the side of the saddle-stitched booklet for corrugation (not shown in drawings).

The end of the plate member 372*a* in the Y direction and the end of the plate member 373*a* in the Y direction are curved to be separated from the saddle-stitched booklet.

This prevents the saddle-stitched booklet from being damaged when the lower end of the booklet is clamped.

It is preferable that each of inner surface portions of the edge clamp member 372 (the plate member 372*a*) and the edge clamp member 373 (the plate member 373*a*) which contact the saddle-stitched booklet includes a mirror-finished portion K2.

This prevents the saddle-stitched booklet from being damaged when the booklet is clamped.

The above FIG. 6 exemplifies a configuration in which the curved portion K1 of the edge clamp member 373 (the plate member 373*a*) corrugates the saddle-stitched booklet. However, the edge clamp member 372 (plate member 372*a*) and the edge clamp member 373 (plate member 373*a*) may have other configurations as long as they can corrugate the saddle-stitched booklet.

Figure 7A:
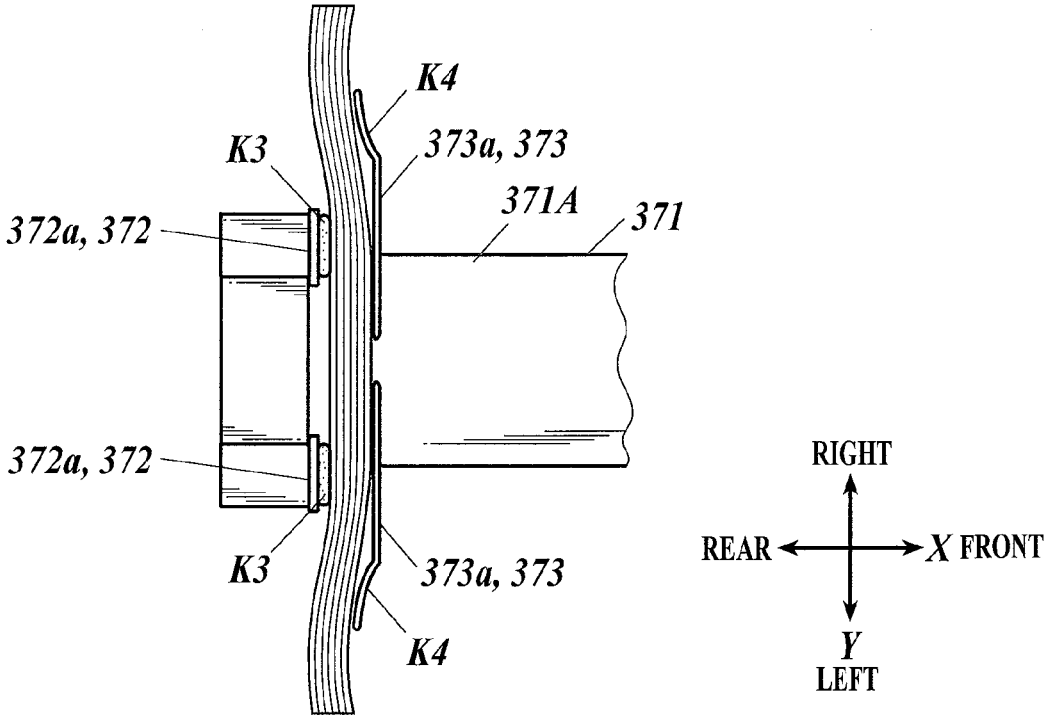
FIG. 7A is a top view illustrating a modification of the edge holding section.

For example, as shown in FIG. 7A, the plate member 372*a* is flat and is provided with an elastic member K3 such as a sponge or a rubber on the clamp surface, that is, the portion that contacts the saddle-stitched booklet. The end of the plate member 373*a* in the Y direction includes a bent portion K4 which is bent to push the saddle-stitched booklet. The plate member 372*a* may not be provided with the elastic member K3.

Figure 7B:
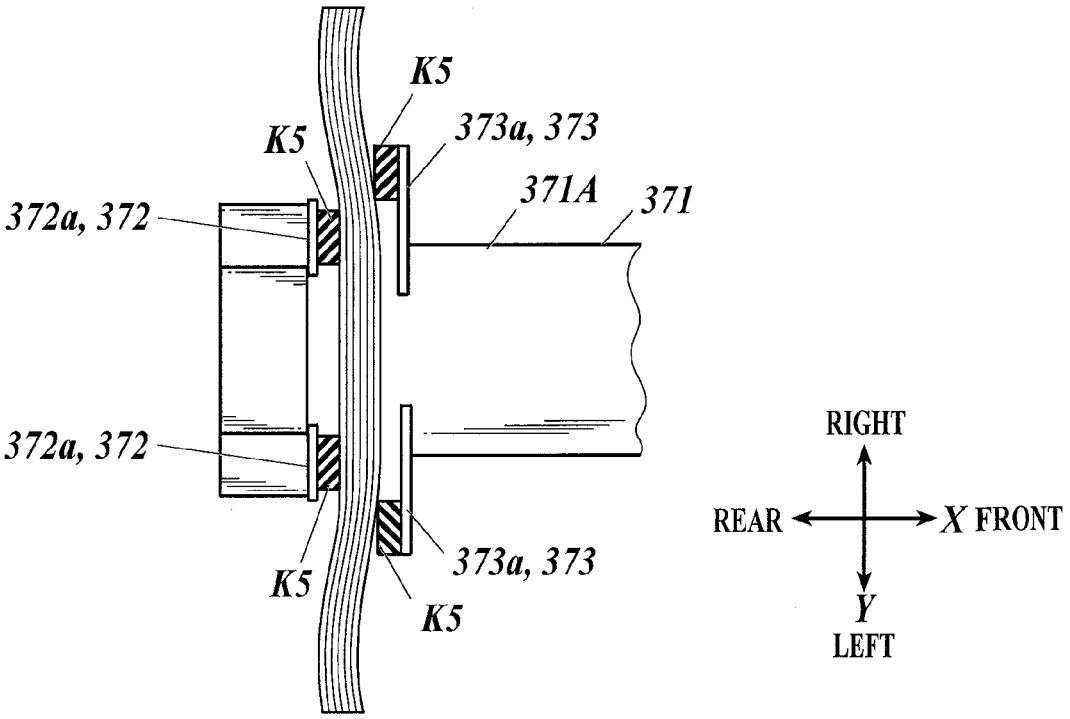
FIG. 7B is a top view illustrating a modification of the edge holding section.

Also, as shown in FIG. 7B, it may be configured that each of the plate member 372*a* and the plate member 373*a* is flat and is provided with an elastic member K5 such as a sponge or a rubber on the inner surface—the portion that contacts the saddle-stitched booklet—of the plate member 372*a* and the plate member 373*a*. Alternatively, it may be configured that only one of the plate member 372*a* and the plate member 373*a* is provided with the elastic member K5.

According to the configurations in FIG. 7A and FIG. 7B, when the lower end of the saddle-stitched booklet is clamped, the step shape of the elastic member K3, the bent portion K4 and the elastic member K5 corrugate the booklet.

Figure 8A:
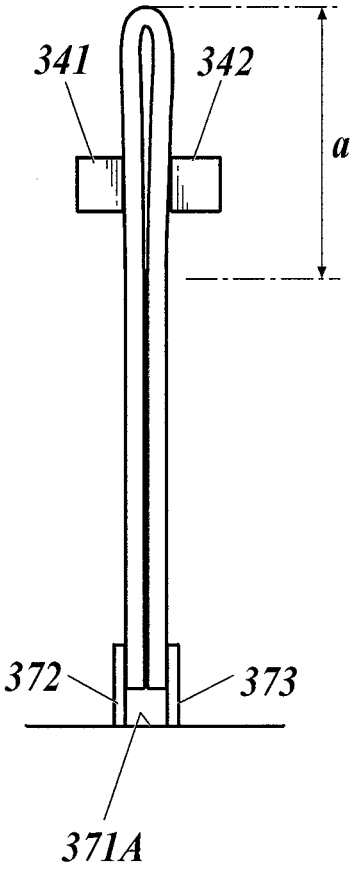
FIG. 8A is a schematic view illustrating the second part by which the clamping section clamps the saddle-stitched booklet.

As shown in FIG. 8A, when the holding unit 371 is approximately horizontal, these edge clamp members 372, 373 clamp and hold the lower end of the saddle-stitched booklet.

When the edge clamp members 372; 373 clamp the saddle-stitched booklet, the end surface of the fore edge on the lower side of the booklet does not contact the main face 371A. Thereby the fore edge of the saddle-stitched booklet is prevented from getting dirty or from being damaged.

Figure 8B:
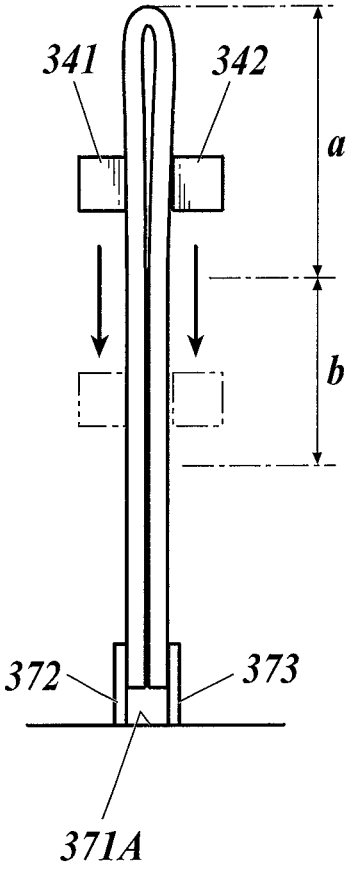
FIG. 8B is a schematic view illustrating the second part by which the clamping section clamps the saddle-stitched booklet.
Figure 8B:
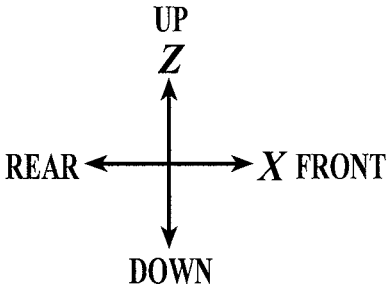

As shown in FIG. 8B, while the edge clamp member 372, 373 clamp the lower end of the saddle-stitched booklet, the pair of clamp members 341, 342 of the clamping section 340 leave the saddle-stitched booklet and move downward to clamp the center (the second part "b") of the booklet in the Z direction.

The ejecting section 380 is above the clamping section 340. The ejecting section 380 includes a loading unit on the upper surface of the sheet processing apparatus 300 and a turnabout unit which receives the saddle-stitched booklet from the clamping section 340 and which ejects the booklet to the loading unit.

After the clamping section 340 conveys the saddle-stitched booklet in a vertical state upward, the turnabout unit turns the booklet to make the booklet approximately horizontal, and then the booklet is ejected so that the booklets are piled up on the loading unit one after another.

Returning to FIG. 1, the side stitching apparatus 400 performs side stitching, etc. for a plurality of sheets.

Specifically, the side stitching apparatus 400 includes, for example, a stapling section which staples sheets received from the sheet processing apparatus 300, a page end trimming section which trims a part of an end portion of the stapled sheets that are parallel to the spine so as to align the end portion, and an ejecting section which ejects the sheets that have been processed by the connected apparatuses.

The side stitching apparatus 400 can eject the sheets received from the sheet processing apparatus 300 without performing a part or all of the various processes by the side stitching apparatus 400.

Next, the operation control of the image forming system 1 will be described.

Figure 9:
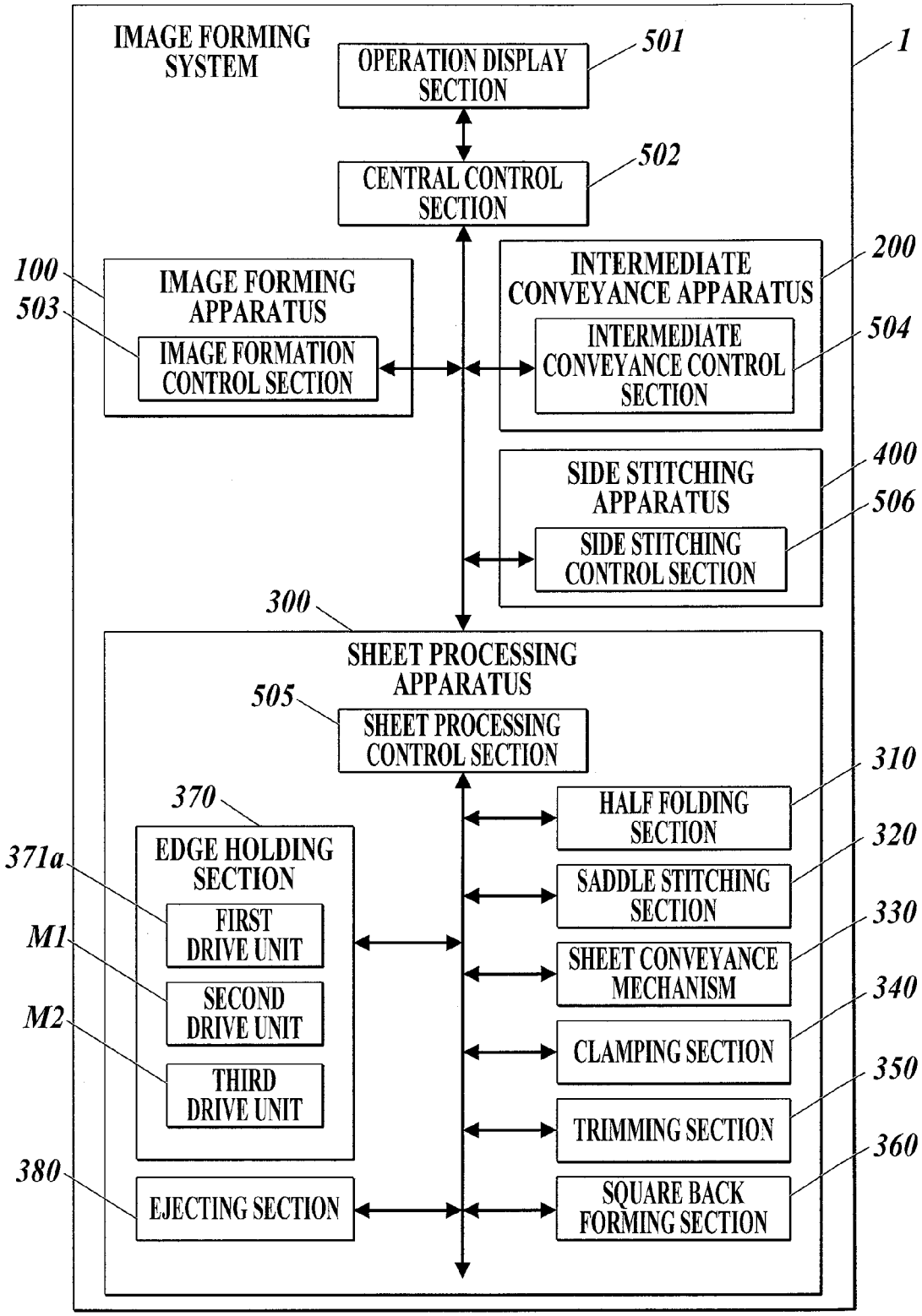
FIG. 9 is a block diagram showing a main configuration of the operation control in the image forming system.

FIG. 9 is a block diagram showing the main configuration according to the operation control in the image forming system 1.

The image forming system 1 includes an operation display section 501 which receives input operation from a user in relation to the operation of the image forming system 1 and which displays in accordance with the operation of the image forming system 1, a central control section 502 which controls operations of the entire image forming system 1, an image formation control section 503 which controls operations of the image forming apparatus 100, an intermediate conveyance control section 504 which controls operations of the intermediate conveyance apparatus 200, a sheet processing control section (control section) 505 which controls operations of the sheet processing apparatus 300 and a side stitching control section 506 which controls operations of the side stitching apparatus 400.

The operation display section 501 includes, for example, a touch panel type operation display unit or switches and keys for various types of input to send a signal according to the input from the user to the central control section 502.

Each of the central control section 502, the image formation control section 503, the intermediate conveyance control section 504, the sheet processing control section 505, and the side stitching control section 506 includes a CPU (Central Processing Unit), a RAM (Random Access Memory), a ROM (Read Only Memory) and such like to read out a software program and various types of data according to processing and execute the processing.

In response to the input from the user via the operation display section 501, the central control section 502 sets various types of conditions concerning the image forming system 1.

These conditions include a sheet size, the number of colors to form images (for example, full-color, gray scale, monochrome, etc.), the number of sheets to be half-folded, nip pressure in the half folding processing, the number of sheets in a single booklet to be saddle-stitched, the type, size and weight of sheets to be saddle-stitched, the number of staples to be inserted into the crease of the sheets in saddle stitching, a position where staples are inserted in saddle stitching (stitching position), whether to trim the fore edge of the saddle-stitched booklet, whether to form a square back along the crease of the saddle-stitched booklet, etc.

Then, the central control section 502 outputs instructions to perform the processing according to the setting to the image formation control section 503, the intermediate conveyance control section 504, the sheet processing control section 505 and the side stitching control section 506. The control sections control operations of the respective apparatuses to be controlled according to the instructions.

For example, the central control section 502 outputs an instruction for performing half folding, saddle stitching, fore edge trimming, square back forming, etc. to the saddle stitching control section 505.

In response to this, the sheet processing control section 505 controls the half folding section 310, the saddle stitching section 320, the sheet conveyance mechanism 330, the clamping section 340, the trimming section 350 and the square back forming section 360 to perform processing.

The sheet processing control section 505 controls the edge holding section 370 to change a part by which the edge holding section 370 holds the saddle-stitched booklet (change a clamp position), and controls the ejecting section 380 to eject the booklet.

Figure 10:
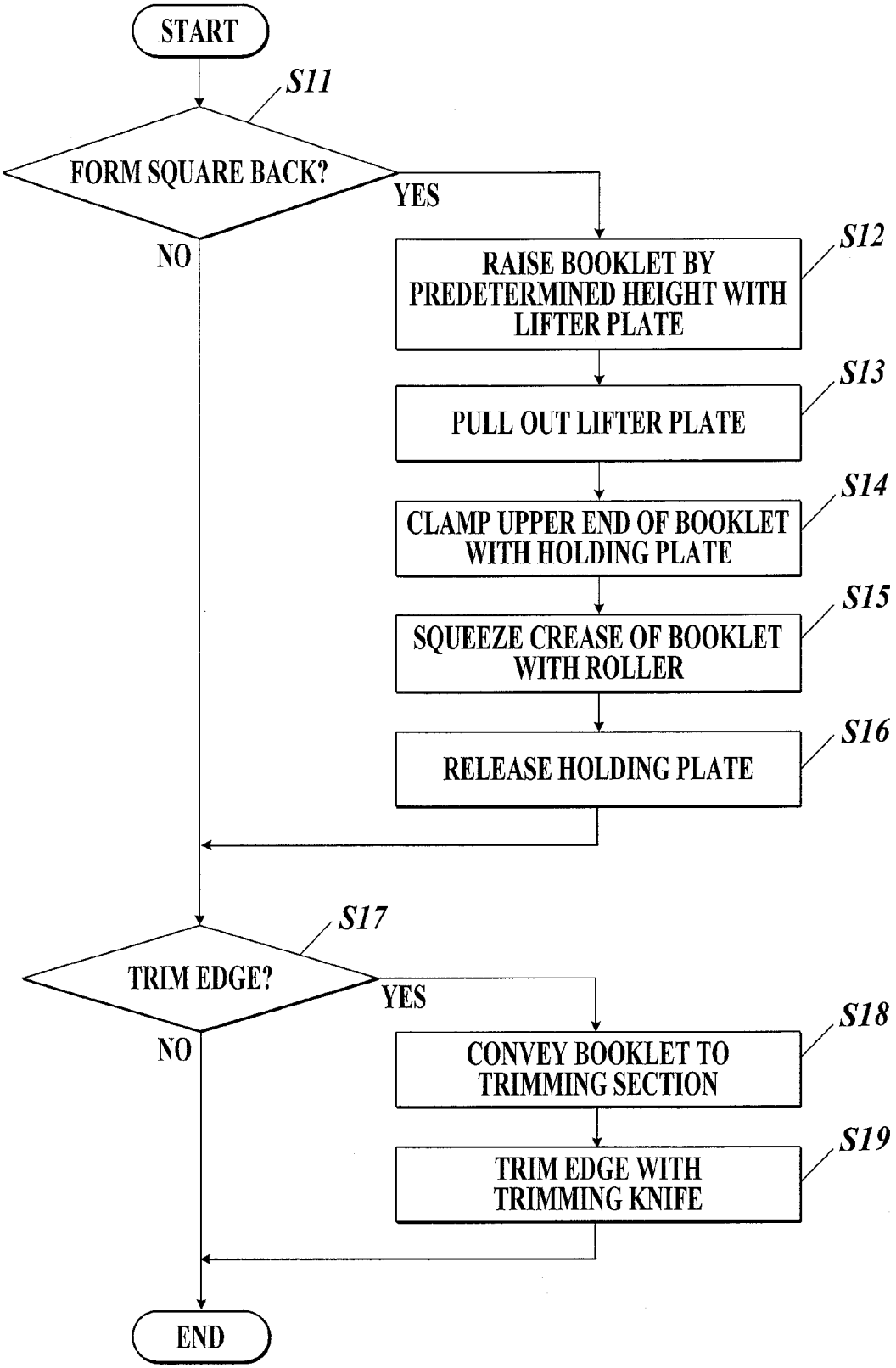
FIG. 10 is a flowchart of square back forming and fore edge trimming.

Trimming by the trimming section 350 and square back forming by the square back forming section 360 according to the embodiment will be explained referring to a flowchart in FIG. 10.

These operations are performed in accordance with control by the sheet processing control section 505 on the basis of a command output by the central control section 502.

Before those operations, the lifter plates 343 pushes up the saddle-stitched booklet and the pair of clamp members 341, 342 clamp the booklet.

First, at Step S11, the sheet processing control section 505 determines whether to form a square back. When determining not to form a square back (Step S11: NO), the sheet processing control section 505 shifts the processing to Step S17, which will be mentioned later. When determining to form a square back (Step S11: YES), the sheet processing control section 505 shifts the processing to following Step S12.

Next, at Step S12, the lifter plate 343 of the sheet processing control section 505 raises the saddle-stitched booklet by a predetermined height. At following Step S13, the lifter plate 343 below the saddle-stitched booklet comes out.

At following Step S14, the sheet processing control section 505 makes the holding plates 361, 362 clamp the upper end around the crease of the saddle-stitched booklet. At following Step S15, the roller squeezes the crease of the saddle-stitched booklet. At following Step S16, the holding plates 361, 362 are released.

Next, at Step S17, the sheet processing control section 505 determines whether to trim a fore edge. When determining not to trim a fore edge (Step S17: NO), the sheet processing control section 505 ends the processing.

On the other hand, when determining to trim a fore edge (Step S17: YES), at Step S18, the sheet processing control section 505 takes down the saddle-stitched booklet to the clamp position of the trim and clamp members 351, 352. At following Step S19, the trimming knife 353 trims the fore edge of the saddle-stitched booklet, and then the sheet processing control section 505 ends the processing.

The above explanation exemplifies a configuration in which whether to trim a fore edge is determined after square back trimming. Alternatively, whether to form a square back and whether to trim a fore edge may be determined substantially at the same time. That is to say, Steps S11 and S12 may be performed at the same time. When a square back is formed and, at the same time, a fore edge is trimmed in this way, Steps S12 to S16 and Steps S18 to S19 can be performed at the same time.

Figure 11:
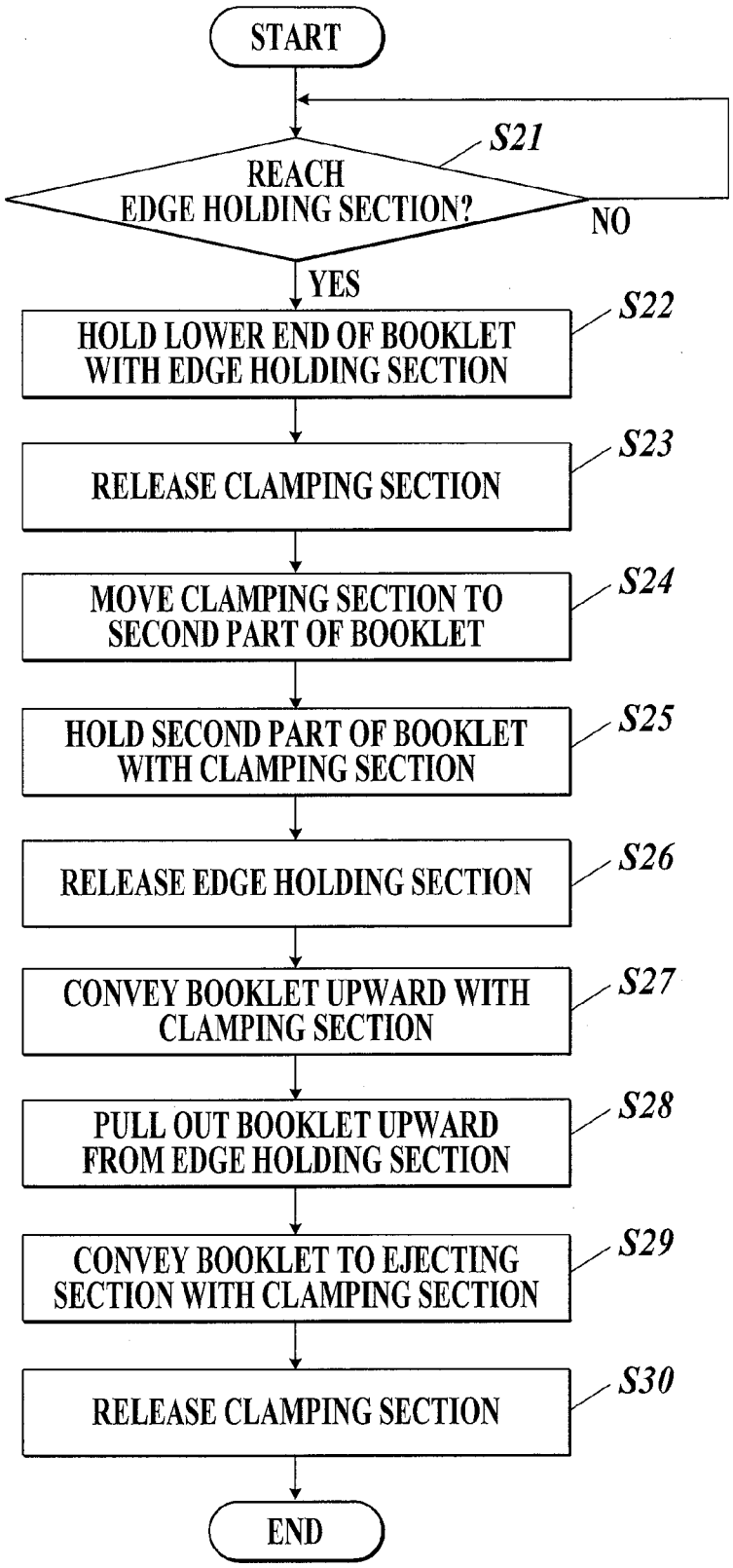
FIG. 11 is a flowchart of operation when a part by which the saddle-stitched booklet is held is changed and when the saddle-stitched booklet is ejected.

Next, change in a part by which the saddle-stitched booklet is held and ejection of the saddle-stitched booklet according to the embodiment will be explained referring to the flowchart in FIG. 11.

These operations are performed in accordance with control by the sheet processing control section 505 on the basis of a command output from the central control section 502.

Before those operations, the pair of clamp members 341, 342 of the clamping section 340 hold the first part "a" of the saddle-stitched booklet.

First, at Step S21, the sheet processing control section 505 makes the clamping section 340 move the saddle-stitched booklet and determines whether the lower end of the booklet reaches the edge holding section 370.

When the lower end of the saddle-stitched booklet does not reach the edge holding section 370 (Step S21: NO), the sheet processing control section 505 repeats this Step S21. When the lower end of the saddle-stitched booklet reaches the edge holding section 370 (Step S21: YES), at following Step S22, the sheet processing control section 505 makes the edge clamp members 372, 373 of the edge holding section 370 hold the saddle-stitched booklet by a part around the fore edge (see FIG. 8A).

Next, at following Step S23, the sheet processing control section 505 makes the clamp members 341, 342 of the clamping section 340 release the first part "a".

At this step, the shapes of the edge clamp members 372, 373 of the edge holding section 370 prevents the saddle-stitched booklet from falling flat.

Next, at Step S24, the sheet processing control section 505 makes the clamping section 340 move to the center (the second part "b") of the saddle-stitched booklet in the Z direction (see FIG. 8B).

Next, at Step S25, the sheet processing control section 505 makes the clamp members 341, 342 of the clamping section 340 clamp and hold the center (the second part "b") of the saddle-stitched booklet in the Z direction.

Next, at following Step S26, the sheet processing control section 505 makes the edge clamp members 372, 373 of the edge holding section 370 release the booklet.

These operations allows the clamp members 341, 342 of the clamping section 340 to hold an appropriate part (the second part "b") of the saddle-stitched booklet, and prevents the booklet from being damaged by the edge clamp members 372, 373 of the edge holding section 370.

Next, at following Step S27, the sheet processing control section 505 makes the clamping section 340 convey the saddle-stitched booklet upward. At following Step S28, the sheet processing control section 505 pulls the saddle-stitched booklet out of the edge clamp members 372, 373.

Next, at Step S29, the sheet processing control section 505 makes the clamping section 340 convey the saddle-stitched booklet to the ejecting section 380. At following Step S30, the sheet processing control section 505 makes the edge clamp members 341, 342 of the clamping section 340 release the second part "b".

As described above, this embodiment includes the clamping section 340 which clamps a saddle-stitched booklet, the edge holding section 370 which clamps and, at the same time, corrugates the booklet, the sheet processing control section 505 which controls operation of the clamping section 340 and the edge holding section 370. The sheet processing control section 505 makes the edge holding section 370 hold sheets while making the clamping section 340 hold the first part "a" of the saddle-stitched booklet. Then the sheet processing control section 505 makes the clamping section 340 release the first part "a", move along the booklet and hold the second part "b" while making the edge holding section 370 keep holding the saddle-stitched booklet.

Since the edge holding section 370 clamps and holds the saddle-stitched booklet in this way, the holding members do not contact and damage the end surface of the booklet on the fore edge side. Also, since the edge holding section 370 clamps the saddle-stitched booklet corrugating the booklet, the booklet does not fall flat when the clamping section 340 leaves the booklet.

Thus the edge holding section 370 stably keep the saddle-stitched booklet in a vertical state without damaging the fore edge while changing a part of the booklet which is held by the clamping section 340.

According to the embodiment, the clamping section 340 is placed above the edge holding section 370. The sheet processing control section 505 makes the edge holding section 370 hold a part around the fore edge of the saddle-stitched booklet, and makes the clamping section 340 hold a part around the crease of the booklet, which is the first part "a", and also hold the center of the booklet in the up and down direction, which is the second part "b".

Therefore the saddle-stitched booklet is sufficiently inserted into the ejecting section 380 when the booklet is ejected upward.

According to the embodiment, the edge holding section 370 includes the curved portion K1 at a portion that contacts the saddle-stitched booklet.

Therefore the saddle-stitched booklet is corrugated without being damaged, and is kept in a stable state.

According to the embodiment, the edge holding section 370 includes the elastic member K3 at a portion that contacts the saddle-stitched booklet.

Since the edge clamp members 372, 373 do not directly contact the saddle-stitched booklet, the booklet is corrugated without being damaged, and is kept in a stable state.

According to the embodiment, the edge holding section 370 includes the mirror-finished portion K2 at a portion that contacts the saddle-stitched booklet.

Therefore the saddle-stitched booklet is prevented from being damaged by roughness of the inner surface of the edge clamp members 372, 373.

The above embodiment exemplifies a configuration in which the clamping section 340 is the first holder, the edge holding section 370 is the second holder, and the first holder is placed above the second holder. However, the relation between the first holder and the second holder concerning vertical positions can be others as long as it is possible that, after the second holder holds the saddle-stitched booklet while the first holder holds the booklet by the first part, the part by which the first holder holds the booklet can be changed from the first part to the second part while the second holder holds the booklet.

The above embodiment exemplifies a configuration in which the clamping section 340 as the first holder moves downward along the saddle-stitched booklet. However, the first holder may move upward or horizontally along the saddle-stitched booklet.

The above embodiment exemplifies a configuration in which each of the edge clamp members 372, 373 of the edge holding section 370 includes two plate members. However, the edge clamp members 372, 373 can have other shapes as long as they can clamp a fore edge of a saddle-stitched booklet. For example, each of the edge clamp members 372, 373 may be constituted by one wide plate member or by three or more plate members.

It is also possible to configure such that the distance between the edge clamp members 372, 373 of the edge holding section 370 is adjustable in accordance with the thickness of the saddle-stitched booklet. In this case, the sheet processing control section 505 performs control to change the distance between the edge clamp members 372, 373 in accordance with a set condition.

Such configuration achieves more appropriate corrugation that suits the thickness of the saddle-stitched booklet.

The above embodiments include a case where a fore edge is trimmed after a square back is formed and a case where a fore edge is trimmed while a square back is formed. However, it is also possible that a square back is formed after a fore edge is trimmed.

The above embodiment exemplifies a configuration in which both of the trimming section 350 and the square back forming section 360 are provided. However, it is also possible that only one of the trimming section 350 and the square back forming section 360 is provided.

The above embodiment exemplifies a configuration in which the square back forming section 360 is loaded on the clamping section 340. However, the clamping section 340 and the square back forming section 360 may be separate. In that case, a fore edge may be trimmed after a square back is formed. Alternatively, a square back may be formed after a fore edge is trimmed.

The entire disclosure of Japanese Patent Application No. 2013-184015 filed on Sep. 5, 2013 including description, claims, drawings, and abstract are incorporated herein by reference in its entirety.

What is claimed is:

1. A sheet processing apparatus which vertically conveys a sheet which has a crease at a center of the sheet and which is in a vertical state in which the crease is on a top and a fore edge of the sheet is on a bottom, the apparatus comprising:

a first holder which clamps and holds the sheet;

a second holder which comprises clamp members which clamp the sheet to corrugate the sheet when the second holder holds the sheet; and a control unit which controls operation of the first and second holders, wherein the control unit controls the first and second holders such that the second holder holds the sheet while the first holder holds a first part of the sheet, and then, while the second holder holds the sheet, the first holder releases the first part of the sheet, moves along the sheet and holds a second part of the sheet, wherein the second holder further comprises a main face on which the clamp members are provided, and wherein the clamp members are rotatable between (i) a first position in which the clamp members are on the same plane as the main face, and (ii) a second position in which the clamp members stand up on the main face to oppose each other.

2. The sheet processing apparatus according to claim 1, wherein the control unit controls the first holder to move along the sheet in a vertical direction.

3. The sheet processing apparatus according to claim 1, wherein the control unit controls the first holder to move along the sheet downward.

4. The sheet processing apparatus according to claim 1, wherein the first holder is placed above the second holder, wherein the second holder holds a part around the fore edge of the sheet, and wherein the first part is a part around the crease of the sheet, and the second part is a center of the sheet in an up and down direction.

5. The sheet processing apparatus according to claim 1, wherein the second holder includes a curved portion at a portion where the second holder contacts the sheet.

6. The sheet processing apparatus according to claim 1, wherein the second holder includes an elastic member at a portion where the second holder contacts the sheet.

7. The sheet processing apparatus according to claim 1, wherein the second holder includes a mirror-finished portion at a portion where the second holder contacts the sheet.

8. The sheet processing apparatus according to claim 1, further comprising a trimming section which trims the fore edge of the sheet, wherein the control unit controls the first holder to move down while holding the first part and controls the trimming section to trim the fore edge of the sheet.

9. The sheet processing apparatus according to claim 1, further comprising a square back forming section which squeezes the crease of the sheet flat to form a square back, wherein the control unit controls the first holder to move while holding the first part of the sheet and controls the square back forming section to form the square back along the crease.

10. The sheet processing apparatus according to claim 1, further comprising:

a trimming section which trims the fore edge of the sheet, and a square back forming section which squeezes the crease of the sheet flat to form a square back, wherein, while the first holder holds the first part, the control unit controls the trimming section to trim the fore edge and controls the square back forming section to form the square back along the crease.

11. An image forming system comprising:

an image forming apparatus which forms an image on a sheet; and the sheet processing apparatus according to claim 1 which is connected to the image forming apparatus, wherein the crease is formed at the center of the sheet after the image forming apparatus forms an image on the sheet.

12. The sheet processing apparatus according to claim 1, wherein the main face is rotatable between a horizontal state and a vertical state, wherein the clamp members are in the first position on the same plane as the main face when the main face is in the vertical state, and wherein the clamp members are rotated to be in the second position to stand up on the main face oppose each other, when the main face is in the horizontal state.

* * * * *